US006424086B1

(12) United States Patent
Odaka et al.

(10) Patent No.: US 6,424,086 B1
(45) Date of Patent: Jul. 23, 2002

(54) COLOR CATHODE-RAY TUBE HAVING NONGLARE MEANS ON INTERNAL SURFACE OF FACEPLATE

(75) Inventors: Yoshiyuki Odaka, Chiba-ken; Masahiro Nishizawa, Mobara; Toshimasa Ishigaki, Chiba, all of (JP)

(73) Assignees: Hitachi, Ltd., Tokyo; Hitachi Device Engineering Co., Ltd., Mobara, both of (JP)

( * ) Notice: Subject to any disclaimer, the term of this patent is extended or adjusted under 35 U.S.C. 154(b) by 1221 days.

(21) Appl. No.: 08/548,759

(22) Filed: Oct. 26, 1995

(30) Foreign Application Priority Data

Oct. 31, 1994 (JP) ..... 6-267566

(51) Int. Cl.[7] ..... H01J 29/28; H01J 29/89
(52) U.S. Cl. ..... 313/466; 313/479
(58) Field of Search ..... 313/466, 473, 313/474, 489, 461, 480, 479, 112, 116, 503

(56) References Cited

U.S. PATENT DOCUMENTS 4,622,272 A * 11/1986 Wengert et al. ..... 313/503
5,101,136 A * 3/1992 Gibilini et al. ..... 313/474
5,141,461 A * 8/1992 Nishimura et al. ..... 313/466
5,177,400 A * 1/1993 Iwasaki ..... 313/466

FOREIGN PATENT DOCUMENTS

JP 250540 * 11/1991

* cited by examiner

*Primary Examiner*—Michael H. Day
(74) *Attorney, Agent, or Firm*—Antonelli, Terry, Stout & Kraus, LLP

(57) ABSTRACT

A color cathode-ray tube providing a nonglare effect which can be regenerated without degradation of its nonglare function and which can be inexpensively formed. A light scattering film composed of metal containing compound micro-particles having a high index of refraction and a particle size of 0.1 $\mu$m to 2 $\mu$m is formed in contact with the internal surface of a faceplate of the color cathode-ray tube, and a black matrix having a multiplicity of holes is formed on the light scattering film. A red phosphor layer, a green phosphor layer and a blue phosphor-layer are formed in the holes of the black matrix on the light scattering film in such a manner that the phosphor layers of red, green and blue are disposed cyclically in that order. External light incident on the faceplate is partly reflected by the external surface of the faceplate, and the remainder of the external light passes through the faceplate and is made incident on the light scattering film. The external light is scattered by the metal containing compound micro-particles having a high index of refraction, so that no substantial light components of the external light again penetrate into the face plate thereby providing a nonglare effect.

20 Claims, 3 Drawing Sheets

COLOR CATHODE-RAY TUBE HAVING NONGLARE MEANS ON INTERNAL SURFACE OF FACEPLATE

BACKGROUND OF THE INVENTION

1. Field of the Invention

The present invention relates to a color cathode-ray tube and, more particularly, to a color cathode-ray tube having a faceplate the internal surface of which is provided with a light scattering film for scattering external light.

2. Description of the Prior Art

In general, color cathode-ray tubes have a faceplate the internal surface of which is provided with antiglare means (for preventing glare) in order to prevent a display image from being visually impaired when external light which has entered the faceplate is reflected by a phosphor screen and the reflected light again passes through and exits from the faceplate.

As conventional internal-reflection preventing means, it is well known to erode the internal surface of a glass-made faceplate with ammonium fluoride or the like and form a multiplicity of irregularities on the internal surface by such erosion. In this case, a black matrix of predetermined shape is formed on the internal surface of the faceplate of the color cathode-ray tube on which such irregularities are formed, and three color phosphor layers are sequentially formed on the black matrix, thereby forming a required color fluorescent screen. In the color cathode-ray tube having the above-described constitution, external light which has entered the faceplate is scattered by the multiplicity of irregularities formed on the internal surface of the faceplate, whereby reflected light is prevented from exiting from the faceplate to prevent degradation of contrast.

The aforesaid known internal-reflection preventing means is capable of scattering external light, which enters the faceplate of the color cathode-ray tube, by means of the multiplicity of irregularities formed on the faceplate and preventing reflected light from exiting from the faceplate, but has various problems which will be described below.

A first problem is that the multiplicity of irregularities formed on the internal surface if the faceplate are deformed during panel cleaning which is performed before the black matrix is formed on the internal surface of the faceplate of the color cathode-ray tube. As the number of panel cleanings increases, the multiplicity of irregularities decrease in size, so that the internal-reflection preventing effect on the internal surface of the faceplate is reduced.

A second problem is that the treatment cost required to form the multiplicity of irregularities on the internal surface of the faceplate of the color cathode-ray tube is high and the formed multiplicity of irregularities is difficult to maintain.

A third problem is that if serious defects such as scratches occur in the internal surface of the faceplate of the color cathode-ray tube, it is impossible to regenerate the color cathode-ray tube.

A fourth problem is that if the black matrix is formed by using a fluorescent screen forming method based on a known photolithography, the shapes of black matrix holes are degraded.

Another internal-reflection preventing means using interference of light is known. For example, Japanese Patent Laid-Open No. 58739/1988 states that a layer of low index of refraction and a layer of high index of refraction are formed on the internal surface of a panel so that an anti-reflection effect can be obtained from interference of light.

However, it is difficult to form the internal-reflection preventing means using interference of light.

Still another internal-reflection preventing means having progressively decreasing indexes of refraction is known, and this is one modification of the aforesaid internal-reflection preventing means using interference of light. For example, Japanese Patent Laid-Open No. 250540/1991 describes an anti-reflection film which is formed by coating the internal surface of a faceplate with an alcohol solution of $Si(OR)_4$ (R: alkyl group) which contains $SiO_2$ particles and firing the alcohol solution. This internal-reflection preventing means is also difficult to form, and is poor in mass-productivity since it is necessary to arrange the particles in a layer and fill the clearances between the particles with a hydrolyzed substance of $Si(OR)_4$.

SUMMARY OF THE INVENTION

The present invention is intended to solve the above-described problems, and its object is to provide a color cathode-ray tube including antiglare or nonglare means which can be regenerated without degradation of its antiglare function and which can be inexpensively formed.

To achieve the above object, in accordance with the present invention provides, as first means, a light reflecting film composed of metallic-compound micro-particles having a high index of refraction and a particle size of 0.1 $\mu$m to 2 $\mu$m is provided on the internal surface of the faceplate of the color cathode-ray tube. The term "light scattering film" means a film which yields an antiglare effect by scattering light.

To achieve the above object, in accordance with the present invention, as second means, a light scattering film is provided on the internal surface of the faceplate of a color cathode-ray tube, the light scattering film being composed of at least one of a black matrix film which contains graphite and metallic-compound micro-particles having a high index of refraction and a particle size of 0.1 $\mu$m to 2 $\mu$m and a precoat film which contains metallic-compound micro-particles having a high index of refraction and a particle size of 0.1 $\mu$m to 2 $\mu$m.

According to the first means, external light incident on the faceplate is scattered by the light scattering film which is formed on the internal surface of the faceplate, so that reflected light can be prevented from passing through and exiting from the faceplate, thereby preventing degradation of contrast. The light scattering film can be regenerated, and it is possible to form the light scattering film inexpensively compared to the formation of irregularities by erosion.

According to the second means, external light incident on the faceplate is scattered by each of the black matrix portion and the light scattering film portion which are formed on the internal surface of the faceplate, so that reflected light can be prevented from passing through and exiting from the faceplate, thereby preventing degradation of contrast. The precoat film and the black matrix film can be regenerated, and it is possible to form these films inexpensively compared to the formation of irregularities by erosion.

DESCRIPTION OF THE PREFERRED EMBODIMENTS

Figure 1:
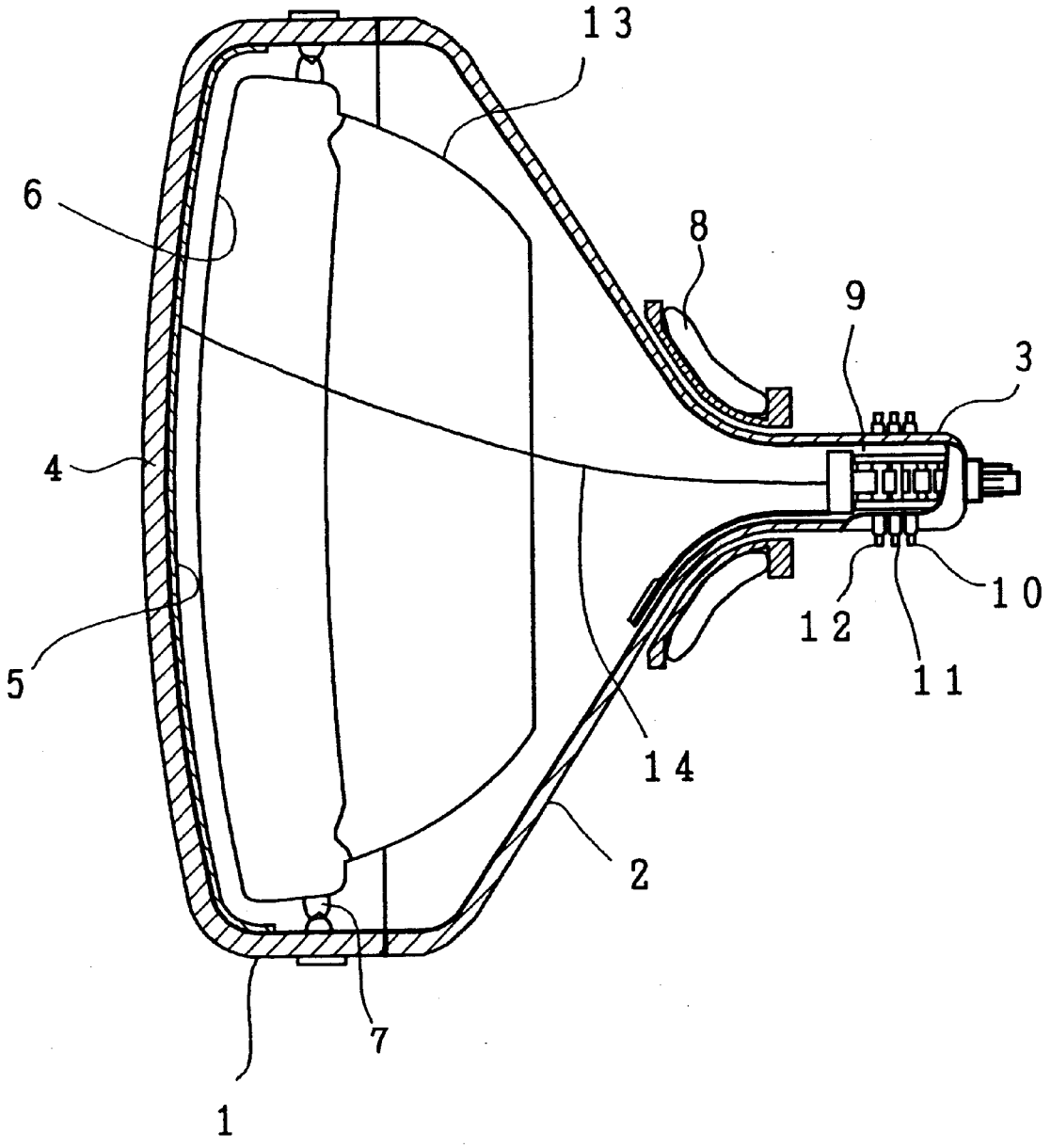
FIG. 1 is a cross-sectional diagrammatic view showing one example of the construction of a color cathode-ray tube according to the present invention.

FIG. 1 is a cross-sectional diagrammatic view showing one example of the construction of a color cathode-ray tube according to the present invention. The cathode-ray tube shown in FIG. 1 includes a panel 1, a funnel 2, a neck 3, a faceplate 4, a color fluorescent screen 5, a shadow mask 6, a mask frame 7, a deflection yoke 8, in-line electron guns 9, a purity adjustment magnet 10, a center-beam static convergence adjustment magnet 11, a side-beam static convergence adjustment magnet 12, a magnetic shield 13 and an electron beam 14.

A glass-made envelope which constitutes part of the color cathode-ray tube includes the panel 1 disposed on the front side of the envelope, the neck 3 which accommodates the in-line electron guns 9, and the funnel 2 disposed at an intermediate portion between the panel 1 and the neck 3. The panel 1 has the faceplate 4 on its front face, and the color fluorescent screen 5 is formed and arranged on the internal face of the faceplate 4. The mask frame 7 is fixedly disposed inside the peripheral portion of, the panel 1, and the shadow mask 6 is mounted by the mask frame 7 in such a manner as to be opposed to the color fluorescent screen 5. The magnetic shield 13 is provided inside a portion at which the panel 1 and the funnel 2 are joined together, and the deflection yoke 8 is provided outside a portion at which the funnel 2 and the neck 3 are joined together. The purity adjustment magnet 10, the center-beam static convergence adjustment magnet 11 and the side-beam static convergence adjustment magnet 12 are disposed side by side outside the neck 3, and three electron beams 14 (one of which is shown) projected from the in-line electron guns 9 are deflected in a predetermined direction by the deflection yoke 8 and reach the color fluorescent screen 5 through the shadow mask 6.

The operation of the color cathode-ray tube having the above-described construction, i.e., an image display operation, is identical to the image display operation of a known color cathode-ray tube. Since such an image display operation is known, the description of the image display operation of the color cathode-ray tube is omitted.

1. First Embodiment

Figure 2:
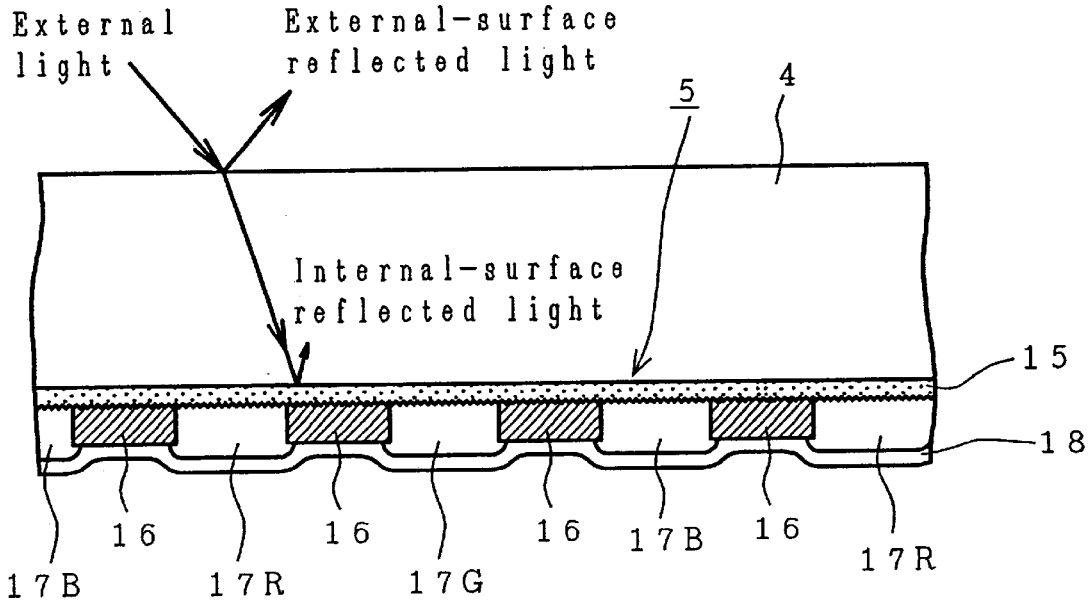
FIG. 2 is a cross-sectional diagrammatic view showing on an enlarged scale the cross-section of a portion of a color fluorescent screen according to a first embodiment of the color cathode-ray tube shown in FIG. 1.

FIG. 2 is a cross-sectional diagrammatic view showing on an enlarged scale the cross-section of a portion of a color fluorescent screen according to a first embodiment of the color cathode-ray tube shown in FIG. 1. The color fluorescent screen shown in FIG. 2 includes a light scattering film 15 having light scattering characteristic and having an antiglare effect, a black matrix 16, aired phosphor layer 17R, a green phosphor layer 17G, a blue phosphor layer 17B, and an aluminum thin film 18. In FIG. 2, identical reference numerals are used to denote constituent elements identical to those shown in FIG. 1.

The color fluorescent screen 5 is provided on the internal face of the faceplate 4 of the color cathode-ray tube. specifically, the color fluorescent screen 5 is composed of the light scattering film 15 having the antiglare effect which is formed and arranged in contact with the internal surface of the faceplate 4, the black matrix 16 which is formed on the light scattering film 15 in such a manner that a multiplicity of holes are disposed at predetermined intervals, the red phosphor layer 17R, the green phosphor layer 17G and the blue phosphor layer 17B which are formed in the holes of the black matrix 16 on the light scattering film 15 in such a manner that the phosphor layers 17R, 17G and 17B are disposed cyclically in that order, and the aluminum thin film 18 which is formed on the exposed surface of the black matrix 16, the red phosphor layer 17R, the green phosphor layer 17G and the blue phosphor layer 17B. The light scattering film 15 is formed by coating the internal surface of the faceplate 4 with a binder material and a liquid which contains metallic-compound micro-particles having a high index of refraction and a particle size of 0.1 $\mu$m to 2 $\mu$m so that the metal particles provide reflection scattering of light so as to achieve the nonglare effect, and drying the coating layer by heating.

The color fluorescent screen 5 having the above-described constitution effects the following function. External light incident on the faceplate 4 of the color cathode-ray tube is partly reflected by the external surface of the faceplate 4, and the remainder of the external light penetrates through the faceplate 4 and reaches the light scattering film 15. The external light which has reached the light scattering film 15 is reflection-scattered in multiple directions by the metallic-compound micro-particles having a high index of refraction and a particle size of 0.1 $\mu$m to 2 $\mu$m, and the major part of the external light disappears in the vicinity of the light scattering film 15. Accordingly, since no substantial portion of the external light is reflected by the light scattering film 15 to penetrate through and exit from the faceplate 4, it is possible to provide color cathode-ray tubes having high contrast characteristics.

The light scattering film 15 may be formed by any of means which will be generally described below. The metallic compound having a high index of refraction is suitably selected from among $SiO_2$, ZnO, $Al_2O_3$, $TiO_2$, $Ce_2O_3$, $SnO_2$, $MgF_2$ and $CaF_2$. The index of refraction suitably ranges from 1.35 to 2.2. Each of the following examples will be described with reference to a case in which silicon dioxide ($SiO_2$) is employed as a metallic compound having a high index of refraction and one of water glass, a silane coupling agent and a photosensitive substance is employed as a binder.

First means is as follows. A polymer solution is prepared which has a composition composed of PVA (polyvinyl alcohol) (1 weight %), silicon dioxide having an average particle diameter of 0.5 $\mu$m (2 weight %), water glass (0.5 weight %) and pure water (balance). The inside of the panel 1 of the color cathode-ray tube is coated with the polymer solution while the polymer solution is being spun at 200 rpm for 15 seconds. After that, the polymer solution is dried by heating at about 50° C. by using a far-infrared heater, thereby forming the light scattering film 15.

Second means is as follows. A photosensitive solution is prepared which has a composition composed of PVP (1 weight %), silicon dioxide having an average particle diameter of 0.5 $\mu$m (2 weight %), azide (0.1 weight %) and pure water (balance). The inside of the panel 1 of the color cathode-ray tube is coated with the photosensitive solution while the photosensitive solution is being spun at 200 rpm for 15 seconds. After that, the photosensitive solution is dried by heating at about 50° C. by using a far-infrared heater, thereby forming a coating film. The coating film is exposed to light over its entire surface and washed with water, whereby the light scattering film 15 is formed.

Third means is as follows. A photosensitive solution is prepared which has a composition composed of PVP (1 weight %), silicon dioxide having an average particle diameter of 0.5 μm (2 weight %), SDC (0.1 weight %) and pure water (balance). The inside of the panel 1 of the color cathode-ray tube is coated with the photosensitive solution while the photosensitive solution is being spun at 200 rpm for 15 seconds. After that, the photosensitive solution is dried by heating at about 50° C. by using a far-infrared heater, thereby forming a coating film. The coating film is exposed to light over its entire surface and washed with water, whereby the light scattering film 15 is formed.

Fourth means is as follows. A polymer solution is prepared which has a composition composed of primer (2 weight %), silicon dioxide having an average particle diameter of 0.5 μm (2 weight %), a silane coupling agent (0.01 weight %) and pure water (balance). The inside of the panel 1 of the color cathode-ray tube is coated with the polymer solution while the polymer solution is being spun at 200 rpm for 15 seconds. After that, the photosensitive solution is dried by heating at about 60° C. by using a far-infrared heater, thereby forming the light scattering film 15.

Figure 3:
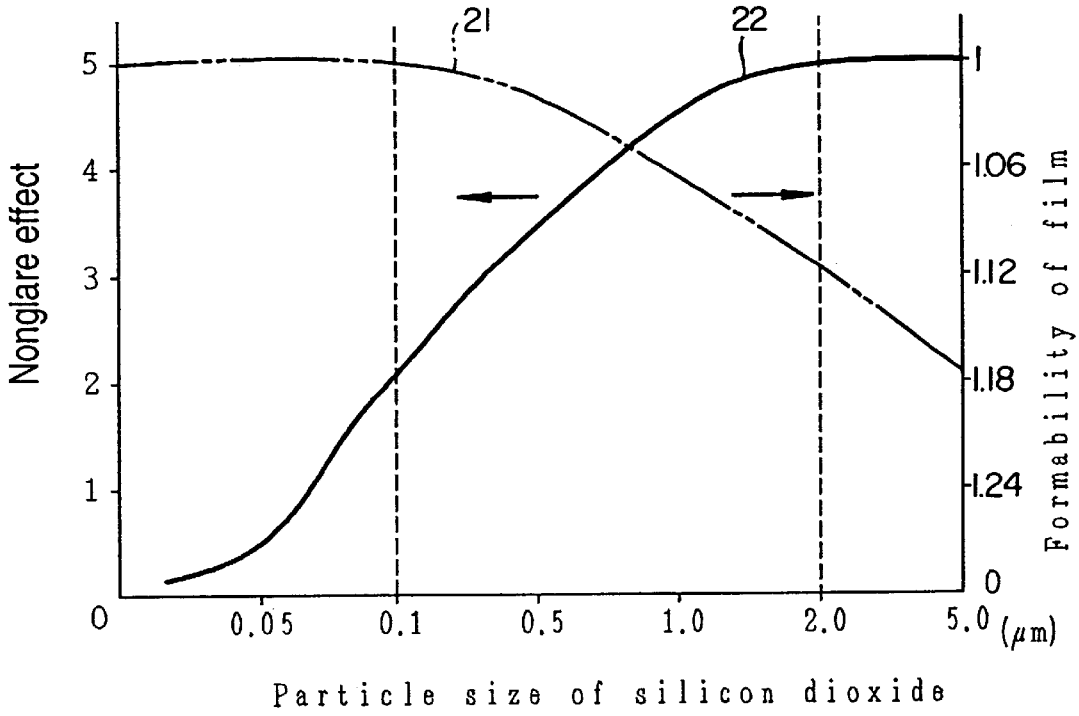
FIG. 3 is a characteristic chart showing the relationship between the particle size of silicon dioxide which constitutes a light scattering film, the extent of the nonglare effect of the light scattering film and the formability of the light scattering film.

FIG. 3 is a characteristic chart showing the relationship between the particle size of silicon dioxide which constitutes the light scattering film 15, the extent of the antiglare effect of the light scattering film 15 as determined by viewing the faceplate and the precision of a film on formation of the light scattering film 15.

In FIG. 3, the abscissa shows the particle size of silicon dioxide in μm, and the ordinates show the extent of the antiglare or nonglare effect and the formability of the film on the antiglare or nonglare film 15, curve 21 shows the relationship between particle size of silicon dioxide and the formability of film i.e., the preciseness of formation of a film on the nonglare film, and curve 22 shows the relationship between particle size of silicon dioxide and the nonglare effect.

As shown by curve 22 in FIG. 3, as the particle size of silicon dioxide becomes smaller, the extent of the antiglare or nonglare effect of the light scattering film 15 is considerably reduced and on the other hand as shown by curve 21 in FIG. 3, as the particle size of silicon dioxide becomes larger, the light scattering film 15 increases and the extent of formability of a film which is formed on the light scattering film 15 increases. From the above-described points, it is practically desirable that the particle size of silicon dioxide used for the light scattering film 15 range from 0.1 μm to 2 μm.

A color cathode-ray tube provided with the aforesaid light scattering film 15 was prepared through an ordinary manufacturing process. The status of internal reflection was checked while this color cathode-ray tube was operating, and it was found out that a good display screen on which internal reflection was completely invisible was obtained.

According to each of the above-described means, a light scattering film is formed by adhesively fixing metallic-compound particles having a particle size of 0.1 μm to 2 μm. The formed light scattering film contains small voids. Accordingly, external light incident on a faceplate is scattered by the metallic-compound particles present in the light scattering film formed on the internal surface of the faceplate, whereby reflected light is prevented from exiting from the faceplate to prevent degradation of contrast.

According to the above-described means, since the formation of a black matrix followed by individual color fluorescent screens is performed immediately after the formation of the light scattering film, the internal-reflection preventing function of the light scattering film is not degraded. In addition, even if the formed light scattering film is defective for any reason, the formed light scattering film can be easily removed by an acid or alkali cleaning step which is performed in an ordinary fluorescent-screen forming process, the light scattering film can be regenerated. In addition, since the light scattering film can be formed merely by forming a film of metallic-compound micro-particles having a high index of refraction, it is possible to form the light scattering film inexpensively compared to the formation of irregularities by erosion.

2. Second Embodiment

Figure 4:
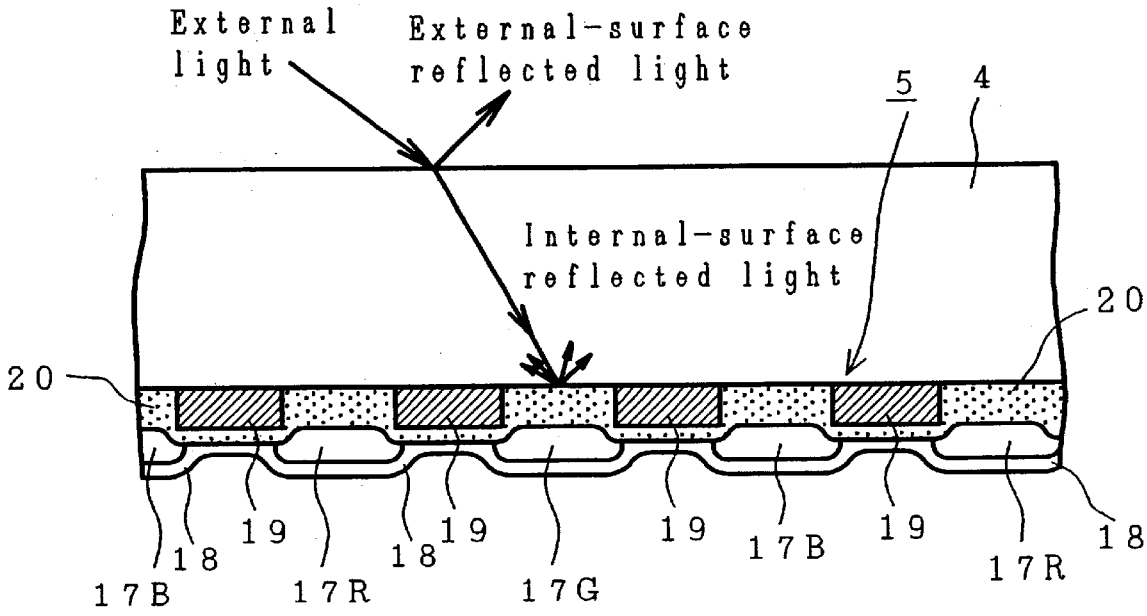
FIG. 4 is a cross-sectional diagrammatic view showing on an enlarged scale the cross-section of a portion of a color fluorescent screen according to a second embodiment of the color cathode-ray tube shown in FIG. 1.

FIG. 4 is a cross-sectional diagrammatic view showing on an enlarged scale the cross-section of a portion of a color fluorescent screen according o a second embodiment of the color cathode-ray tube, shown in FIG. 1.

In FIG. 4, reference numeral 19 denotes a second black matrix, and reference numeral 20 denotes a precoat layer. Both serve as a light scattering film. In FIG. 4, identical reference numerals are used to denote constituent elements identical to those shown in FIG. 2.

The color fluorescent screen 5 is provided on the internal face of the faceplate 4 of the color cathode-ray tube. Specifically, the color fluorescent screen 5 is composed of a second black matrix 19 which is formed on the internal surface of the faceplate 4 in such a manner that a multiplicity of holes are disposed at predetermined intervals, the precoat layer 20 which is formed and disposed on the second black matrix 19 and on the internal surface of the faceplate 4 in each of the holes of the second black matrix 19, the red phosphor layer 17R, the green phosphor layer 17G and the blue phosphor layer 17B which are formed on the precoat layer 20 in such a manner that the phosphor layers 17R, 17G and 17B are disposed cyclically in that order, and the aluminum thin film 18 which is formed on the exposed surface of the precoat layer 20, the red phosphor layer 17R, the green phosphor layer 17G and the blue phosphor layer 17B. The second black matrix 19 is composed of graphite and silicon-dioxide transparent micro-particles having a particle size of 0.1 μm to 2 μm. The precoat layer 20 is formed by coating the second black matrix 19 and the exposed internal surface of the faceplate 4 with a binder material and a liquid which contains silicon-dioxide transparent micro-particles having a particle size of 0.1 μm to 2 μm and drying the coating layer by heating.

The color fluorescent screen 5 having the above-described constitution effects the following function. External light incident on the faceplate 4 of the color cathode-ray tube is partly reflected by the external surface of the faceplate 4, and the remainder the external light penetrates through the faceplate 4 and reaches the light scattering film. The external light which has reached the light scattering film is scattered in multiple directions by the silicon-dioxide transparent micro-particles having a particle size of 0.1 μm to 2 μm, which constitute the second black matrix 19, and the silicon-dioxide transparent micro-particles having a particle size of 0.1 μm to 2 μm, which constitute the precoat layer 20, and the major part of the external light disappears in the vicinity of the second black matrix 19 and the precoat layer 20. Accordingly, since no substantial portion of the external light is reflected by the color fluorescent screen 5 to penetrate through and exit from the faceplate 4, it is possible to provide color cathode-ray tubes having high contrast characteristics.

The second black matrix 19 and the precoat layer 20 may be formed by means which will be generally described below.

A solution is prepared which has a composition composed of graphite (5 weight %), silicon dioxide (1 weight %) and pure water (balance). The inside of the panel 1 of the color cathode-ray tube is coated with the solution while the solution is being spun at 150 rpm for 10 seconds. Then, the solution is dried by heating at about 60° C. by using a far-infrared heater, thereby forming a coating film. After that, the coating film is treated for 60 seconds with an etching liquid having a composition composed of hydrogen peroxide (1 weight %), sulfamic acid (0.5 weight %) and pure water (balance). The etched coating film is sprayed with hot water of about 40° C. for 60 seconds at a pressure of 5 $Kg/cm^2$, thereby forming the second black matrix 19.

Then, a solution is prepared which has a composition composed of silicon dioxide having an average particle size of 0.5 $\mu$m (2 weight %), PVA (0.2 weight %), polystyrene (0.2 weight %), colloidal silica (0.2 weight %) and pure water (balance), and the inside of the panel 1 of the color cathode-ray tube on which the second black matrix 19 is formed is coated with the solution while the solution is being spun at 150 rpm for 10 seconds, thereby forming the precoat layer 20.

In the second embodiment as well, the particle size of the silicon-dioxide micro-particles used for the second black matrix 19 and the precoat layer 20 is selected to be 0.1 $\mu$m to 2 $\mu$m, in terms of the extent of the nonglare effect and the formability of the film.

A color cathode-ray tube provided with the aforesaid second black matrix 19 and precoat layer 20 was prepared through an ordinary manufacturing process. The status of internal reflection was checked while this color cathode-ray tube was operating, and it was found out that a good display screen on which internal reflection was completely invisible was obtained similarly to the first embodiment.

In the above-described embodiments, silicon dioxide ($SiO_2$) is used as a metallic compound having a high index of refraction, by way of example. However, similar effects can be obtained by using another substance, such as ZnO, $Al_2O_3$, $TiO_2$, $Ce_2O_3$, $SnO_2$, $MgF_2$ or $CaF_2$, in a similar manner.

In addition, the light scattering film 15 used in the first embodiment may also be used instead of the precoat layer 20.

In addition, with the aforesaid second black matrix 19 alone, it is also possible to provide a display screen which is good compared to a conventional color cathode-ray tube.

According to the second embodiment, a light scattering film is formed on the internal surface of the faceplate of a color cathode-ray tube, the light scattering film being composed of at least one of a black matrix film which contains graphite and silicon-dioxide micro-particles having a high index of refraction and a particle size of 0.1 $\mu$m to 2 $\mu$m and a precoat film which contains silicon-dioxide micro-particles having a high index of refraction and a particle size of 0.1 $\mu$m to 2 $\mu$m. External light incident on the faceplate is scattered in multiple directions by a black matrix portion and a light scattering film portion which are formed on the internal surface of the faceplate, so that reflected light can be prevented from penetrating through and exiting from the faceplate 4, thereby preventing degradation of contrast.

In addition, according to the second embodiment, since the formation of individual color fluorescent screens is performed immediately after the formation of the precoat film, it is possible to prevent degradation of the internal-reflection preventing function of the precoat film and the black matrix film which contains metallic-compound micro-particles having a high index of refraction. In addition, even if the precoat film is defective for any reason, since the precoat film and the black matrix film can be easily removed by an acid or alkali cleaning step which is performed in an ordinary fluorescent-screen forming process, the precoat film and the black matrix film can be regenerated. In addition, the precoat film can be formed merely by forming a film which contains metallic-compound micro-particles having a high index of refraction, whereas an ordinary black matrix forming process can be used for forming the black matrix which contains metallic-compound micro-particles having a high index of refraction. Accordingly, it is possible to form both of them inexpensively compared to the formation of irregularities by erosion.

What is claimed is:

1. A color cathode-ray tube having a black matrix and a phosphor layer disposed with respect to an internal surface of a faceplate, wherein a light scattering film having light scattering characteristics providing a nonglare effect is formed by fixing a metal containing compound having a high index of refraction and a particle size of 0.1 $\mu$m to 2 $\mu$m on said internal surface of said faceplate for providing scattering reflection of external light, and said black matrix and said phosphor layer are formed on said light scattering film.

2. A color cathode-ray tube according to claim 1, wherein said light scattering film having light scattering characteristics is formed by coating said internal surface of said faceplate with a polymer solution which contains said metal containing compound having said high index of refraction and said particle size of 0.1 $\mu$m to 2 $\mu$m and water glass or a silane coupling agent, and firing said polymer solution to fix said polymer solution to said internal surface of said faceplate.

3. A color cathode-ray tube according to claim 1, wherein said light scattering film having said light scattering characteristics is formed by coating said internal surface with a solution which contains a photosensitive substance and said metal containing compound having said high index of refraction and said Particle size of 0.1 $\mu$m to 2 $\mu$m, and exposing said solution to light to fix said solution to said internal surface of said faceplate.

4. A color cathode-ray tube according to claim 1, wherein said color cathode-ray tube is a direct viewing color cathode-ray tube, and said metal containing compound has the high index of refraction which ranges from 1.35 to 2.2 and micro-particles of said particle size.

5. A color cathode-ray tube according to claim 4, wherein said metal containing compound contains a metal of least one of $SiO_2$, ZnO, $Al_2O_3$, $TiO_2$, $Ce_2O_2$, $SnO_2$l $MgF_2$ and $CaF_2$.

6. A color cathode-ray tube according to claim 1, wherein said light scattering film includes at least one of a polymer and a photosensitive substance, said light scattering film providing the nonglare effect without interference of light.

7. A color cathode-ray tube according to claim 1, wherein the particle size of the metal containing compound is substantially greater than 0.2 $\mu$m.

8. A color cathode-ray tube according to claim 7, wherein the particle size is at least 0.5 $\mu$m.

9. A color cathode-ray tube having a black matrix on an internal surface of a faceplate, wherein said black matrix contains graphite and metal containing compound micro-particles having a high index of refraction and particle size of 0.1 μm to 2 μm for providing scattering reflection of external light so as to provide a nonglare effect.

10. A color cathode-ray tube according to claim 9, wherein said color cathode-ray tube is a direct viewing color cathode-ray tube, and said metal containing compound has the high index of refraction which ranges from 1.35 to 2.2.

11. A color cathode-ray tube according to claim 10, wherein said metal containing, compound contains metals of least one of $SiO_2$, ZnO, $Al_2O_3$, $TiO_2$, $Ce_2O_2$, $SnO_2$, $MgF_2$ and $CaF_2$.

12. A color cathode-ray tube according to claim 9, wherein the metal containing compound micro-particles are provided in a film including at least one of a polymer and photosensitive substance, the film providing scattering reflection of external light without interference of light.

13. A color cathode-ray tube according to claim 12, wherein the particle size of the micro-particles is substantially greater than 0.2 μm.

14. A color cathode-ray tube having at least a black matrix on an internal surface of a faceplate, wherein said black matrix contains graphite and metal containing compound micro-particles having a high index of refraction and a particle size 0.1 μm to 2 μm so as to provide a nonglare effect, and comprising a precoat film which provides a nonglare effect and contains metal containing compound micro-particles having a high index of refraction and a particle size of 0.1 μm to 2 μm for providing scattering reflection of external light and disposed on said internal surface said faceplate adjacent to said black matrix.

15. A color cathode-ray tube according to claim 14, wherein said precoat film is formed by coating said internal surface of said faceplate with a polymer solution which contains a metal containing compound having a high index of refraction and a particle size of 0.1 μm to 2 μm and water glass or a silane coupling agent, and firing said polymer solution to fix said polymer solution to said internal surface of said faceplate.

16. A color cathode-ray tube according to claim 14, wherein said precoat film is formed by coating said internal surface of said faceplate with a solution which contains a metal containing compound having a high index of refraction and a particle size of 0.1 μm to 2 μm and a photosensitive substance, and exposing said solution to light to fix said solution to said internal surface of said faceplate.

17. A color cathode-ray tube according to claim 14, wherein said color cathode-ray tube is a direct viewing color cathode-ray tube, and said metal containing compound has the high index of refraction which ranges from 1.35 to 2.12.

18. A color cathode-ray tube according to claim 17, wherein said metal containing compound contains a metal of least one of $SiO_2$, ZnO, $Al_2O_3$, $TiO_2$, $Ce_2O_2$, $SnO_2$, $MgF_2$ and $CaF_2$.

19. A color cathode-ray tube according to claim 14, wherein the precoat film includes at least one of a polymer and a photosensitive substance, the precoat film providing the nonglare effect without interference of the light.

20. A color cathode-ray tube according to claim 19, wherein the particle size is substantially greater than 0.2 μm.

* * * * *